US005563387A

United States Patent [19]

Myers et al.

[11] Patent Number: 5,563,387

[45] Date of Patent: Oct. 8, 1996

[54] MOTORCYCLE IGNITION SWITCH LOCK

[75] Inventors: Gary L. Myers, Monee, Ill.; Robert Courtwright, Evans, Ga.

[73] Assignee: Fort Lock Corporation, River Grove, Ill.

[21] Appl. No.: 429,805

[22] Filed: Apr. 27, 1995

Related U.S. Application Data

[63] Continuation-in-part of Ser. No. 22,345, May 4, 1994, Pat. No. Des. 365,328.

[51] Int. Cl.[6] ..... H01H 27/06

[52] U.S. Cl. ..... 200/43.03; 200/333; 200/302.1; 70/224; 70/159; 70/455

[58] Field of Search ..... 200/43.01, 43.03, 200/43.11, 43.22, 43.07, 333, 303, 302.1, 43.04, 43.08, 43.06, 43.05; 70/DIG. 43, DIG. 56, 455, 215, 216, 229, 159

[56] References Cited

U.S. PATENT DOCUMENTS

| | | | |
|---|---|---|---|
| 3,270,151 | 8/1966 | Godette | 200/43.08 |
| 3,515,832 | 6/1970 | Martin | 200/43.08 |
| 3,556,576 | 1/1971 | Nelson et al. | 70/216 |
| 3,805,565 | 4/1974 | McLarnon | 70/59 |
| 4,023,388 | 5/1977 | Morvai | 70/455 |
| 4,673,776 | 6/1987 | Sambursky | 200/43.08 |
| 5,467,624 | 11/1995 | Myers | 70/455 |

*Primary Examiner*—David J. Walczak
*Attorney, Agent, or Firm*—Leydig, Voit & Mayer, Ltd.

[57] ABSTRACT

A switch lock having a reliable side-opening door and an improved rotatable handle is provided for use in motorcycle ignition systems. The side-opening door is rotatable between an open position wherein the lock plug assembly is exposed and a closed position wherein the lock plug assembly is covered. In the closed position, the side-opening door forms a part of the handle by fitting tightly against the side and top of the handle. The side-opening door also has a latch which receives and securely retains the side-opening door in the closed position. The handle is rotatable into a finite number of predetermined engagement orientations and is lockable at some or all of these orientations.

28 Claims, 3 Drawing Sheets

MOTORCYCLE IGNITION SWITCH LOCK

This is a continuation-in-part application of U.S. application Ser. No. 29/022,345, filed on May 4, 1994, now U.S. Pat. No. 5,365,328.

BACKGROUND OF THE INVENTION

The present invention relates generally to locks and, more particularly concerns an improved ignition switch lock for use in motorcycles.

The switch lock assembly of the present invention has several desirable features including a reliable side-opening door and an improved rotatable handle. The side-opening door is rotatable between an open position wherein the lock plug assembly is exposed and a closed position wherein the lock plug assembly is covered. In the closed position, the side-opening door forms a part of the handle by fitting tightly against the side and top of the handle. The side-opening door also has a latching means for receiving and securely retaining the side-opening door in the closed position. In addition, the handle is rotatable into a finite number of predetermined engagement orientations and is lockable at some or all of these orientations.

OBJECTS AND SUMMARY OF THE INVENTION

The primary object of the present invention is to provide an improved switch lock.

A more detailed object of the present invention is to provide an improved switch lock for use in motorcycle ignition systems.

Another object of the present invention is to provide a switch lock with a side-opening door which alternatively exposes and covers a lock plug.

A associated object of the present invention is to provide a switch lock with a latching means for receiving and securely retaining the side-opening door in the closed (or covered) position.

A further associated object of the present invention is to provide a switch lock with a "snap-in-place" feature which prevents the side-opening door from inadvertently opening.

Another object of the present invention is to provide a switch lock with an improved rotatable handle.

A related object of the present invention is to provide a switch lock wherein the rotatable handle is selectively urged into predetermined engagement orientations during rotation.

A further related object of the present invention is to provide a switch lock wherein the rotatable handle is lockable at predetermined locking orientations.

An additional related object of the present invention is to provide a switch lock wherein the predetermined locking orientations coincide with some or all of the predetermined engagement orientations (i.e. the rotatable handle can be locked in some or all of the predetermined engagement orientations).

Yet another object of the present invention is to provide a lock of the foregoing type which is reliable and convenient to use.

These and other features and advantages of the invention will become apparent upon reading the following description of a preferred exemplified embodiment of the invention, and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the appended claims.

DETAILED DESCRIPTION OF THE PREFERRED EMBODIMENT

Figure 1:
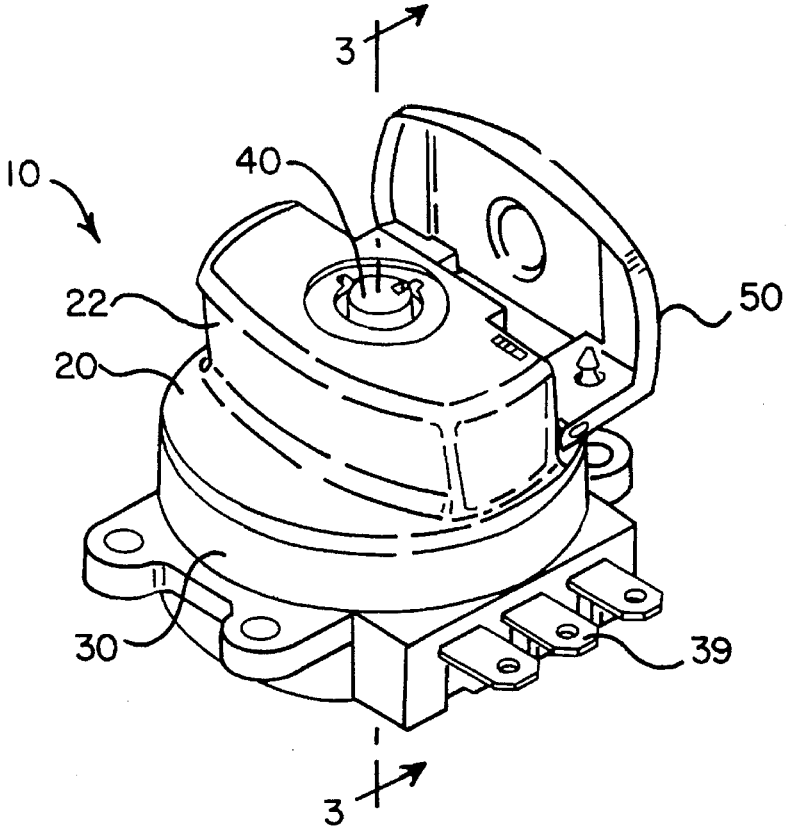
FIG. 1 is a perspective view showing a switch lock assembly in accordance with the present invention.

Referring now specifically to the drawings, FIG. 1 shows a perspective view of a switch lock assembly 10 in accordance with the present invention. For the purposes of discussing the preferred embodiment, the switch lock assembly 10 will be described as being mounted onto a motorcycle (not shown) and used as an ignition lock. Notwithstanding this characterization, it will be readily appreciated by those skilled in the art that the switch lock assembly 10 described and claimed herein may be utilized in other contexts and should not be construed solely as a motorcycle ignition switch lock.

In particular, the switch lock assembly 10 of the present invention broadly comprises an outer housing, a lock plug assembly 40, and a side-opening door 50.

The housing comprises a first portion 20 and a second portion 30. In accordance with certain objects of the claimed invention, the first portion 20 is partially rotatable relative to the second portion 30. The first portion 20 also has a handle portion 22 which aides in grasping and turning the first portion 20. In application, the second portion 30 is mounted directly onto the motorcycle. Thus, in operation, the second portion 30 is stationary and first portion 20 is turned or rotated relative to the second portion 30.

Figure 2:
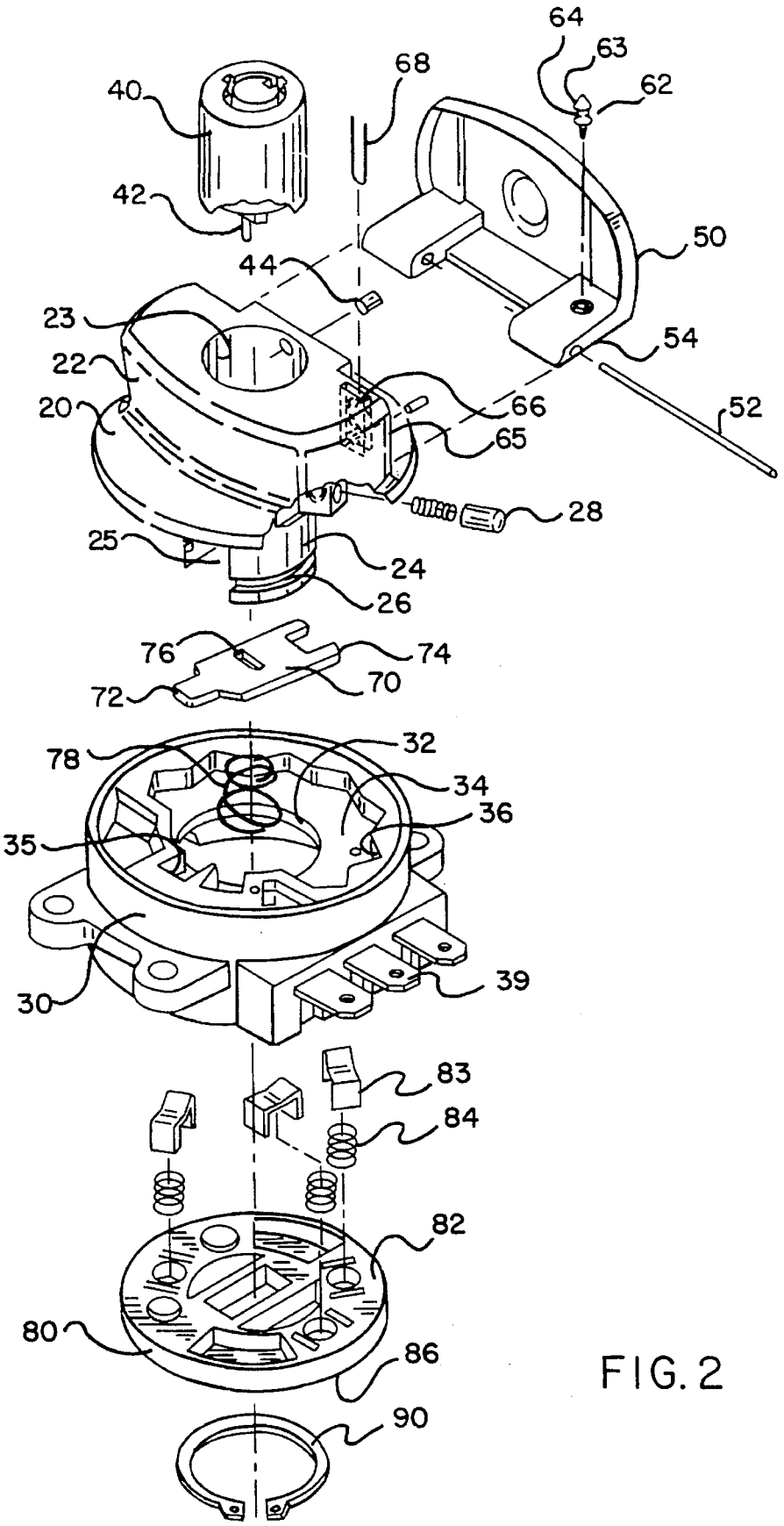
FIG. 2 is an exploded perspective view of the switch lock assembly shown in FIG. 1, exposing the internal component parts thereof.

As best seen in FIG. 2, the lock plug assembly 40 is generally cylindrical in shape and is disposed within a bore 23 extending through the handle 22. The lock plug assembly 40 is aligned within the bore 23 by a retaining plug 44 and is rotatable by a key (not shown). A projecting member 42, offset from the longitudinal axis of the lock plug assembly 40, extends beyond the end of the lock plug assembly 40 and into the second portion 30 of the housing.

The side-opening door 50 is hingedly attached to the first portion 20 of the housing and is rotatable between an open position wherein the lock plug assembly 40 is exposed, as shown in FIG. 1, and a closed position wherein the lock plug assembly 40 is covered. In the closed position, the side-opening door 50 forms a part of the first portion 20 of the housing by fitting tightly against the side and top of the handle 22. Further, as best depicted in FIG. 2, the side-opening door 50 is hingedly attached to the first portion 20 of the housing by a rod 52 which extends through one or more hinge joints 54 on the side-opening door 50 and through one or more hinge joints on the first portion 20 of the housing (not shown).

Pursuant to the invention, the switch lock 10 further comprises a latching means for securely retaining the side-opening door 50 in the closed position. In the illustrated embodiment, the latching means comprises a stud 62 attached to the side-opening door 50 which is received by an aperture 66 disposed on a face 65 of the handle 22. The stud 62 has a generally back-to-back cone-shaped head portion 63 and a narrower stem portion 64. As the side-opening door 50 is rotated toward the closed position, the head portion 63 of the stud 62 engages a clutching means which grasps the head 63 and securely retains the side-opening door 50 in the closed position. In the illustrated embodiment, the clutching means comprises a generally U-shaped spring member 68 disposed inboard of the aperture 66. In operation, as the stud 62 nears the closed position, the U-shaped spring member 68 widens to receive the head portion 63 of the stud 62 and then narrows to grasp the stem portion 64. Accordingly, the latching means keeps the side-opening door 50 firmly in place against the side and top of the handle 22, and, in keeping with an important aspect of the present invention, provides a "snap-in-place" feature which prevents the side-opening door 50 from inadvertently opening. To open the side opening-door 50 and expose the lock plug assembly 40, a force sufficient to overcome the holding force of the clutching means is applied to the side-opening door 50.

The switch lock 10 further comprises an urging-and-locking means for selectively urging the first portion 20 of the housing into predetermined engagement orientations as the first portion 20 is rotated relative to the second portion 30 and for enabling the first portion 20 to be locked relative to the second portion 30 at predetermined locking orientations. Specifically, the predetermined engagement orientations correspond to the finite number of angular orientations (or clock-positions) that the first portion 20 may be rotated into, and the locking orientations correspond to the finite number of angular orientations (or clock-positions) that the first portion 20 of the housing may be locked relative to the second portion 30.

In the illustrated embodiment, the urging-and-locking means broadly comprises a flange 32 having a plurality of detents 35 and notches 36, ring-biased projecting pins 28 attached to the first portion 20 of the housing which retractably engage the notches 36, a dead bolt 70 adapted to engage the detents 35, and a camming means for linearly translating the dead bolt 70.

Figure 4:
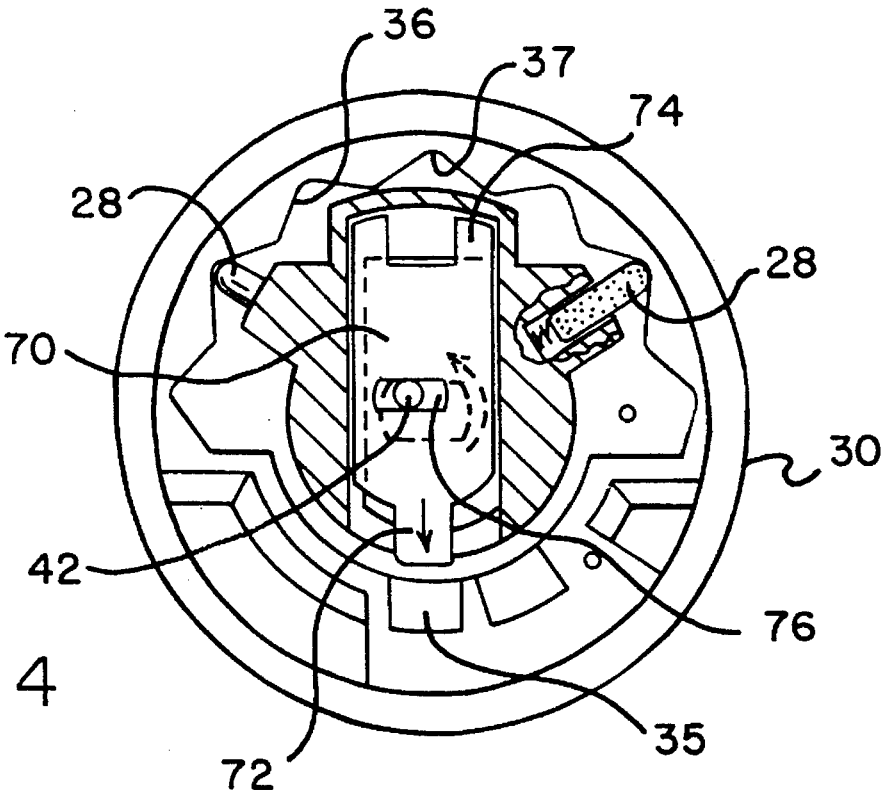
FIG. 4 is a cross-sectional view of the switch lock assembly taken along line 4—4 in FIG. 3.
Figure 5:
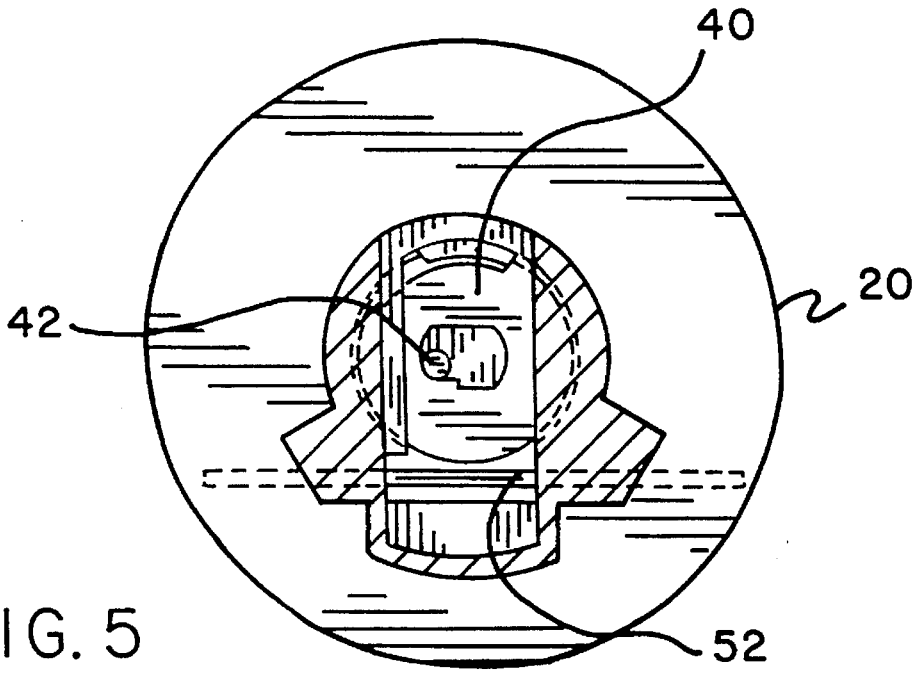
FIG. 5 is a cross-sectional view of the switch lock assembly taken along line 5—5 in FIG. 3.

The flange 32—which is formed within the second portion of the housing—has an inward-projecting side 34, an outward projecting side 38, and an orifice therethrough. The detents 35 and notches 36 are arranged on the inward-projecting side 34 of the flange 32. As best shown in FIG. 4, a pair of spaced-apart spring-biased pins 28 retractably engage the detents 35. In use, as the first portion 20 of the housing is rotated relative to the stationary second portion 30, the spring-biased projecting pins 28 retractably engage the notches 36. This retractable engagement between the spring-biased projection pins 28 and the notches 36 urges the first portion 20 of the housing into the predetermined engagement orientations.

The location and number of notches 36 relative to the location and number of spring-biased projecting pins 28 defines the predetermined engagement orientations. In the illustrated embodiment, for example, the switch lock 10 has two spaced-apart projecting pins 28 and seven notches 36 which yield a total of three predetermined engagement orientations. From the central orientation depicted in FIG. 4, the first portion 20 of the housing may be rotated one notch in either the clockwise or counter-clockwise direction. A seventh, superfluous notch 37—disposed in the middle of the six other notches—is provided but never receives either of the two projecting pins 28. Further, although the illustrated embodiment shows a switch lock 10 having three predetermined engagement orientations, it will be readily apparent to those skilled in the art that the location and number of notches 36 and spring-biased projecting pins 28 may be varied to provide other combinations of predetermined engagement orientations.

As represented in FIG. 2, the first portion 20 of the housing further comprises a stem 24 which extends completely through the orifice in the flange 32 and substantially through the second portion 30 of the housing. A channel 25, substantially aligned with the lock plug assembly 40, is formed in the lowermost portion of the stem 24. The dead bolt 70 is slidably disposed within the channel 25 and on the inward-projecting side 34 of the flange 32. The dead bolt has a first end 72 adapted to fit within the detents 35 on the flange 32, a second end 74 opposite the first end 72, and a slot 76 which receives the offset projecting member 42 of the lock plug assembly 40.

In the illustrated embodiment, the dead bolt 70 is linearly actuated by the camming means. As shown in FIGS. 2 through 5, the camming means generally comprises the slot 76 formed in the dead bolt 70 which receives the offset projecting member 42 of the lock plug assembly 40. In operation, as the lock plug assembly 40 is rotated, the offset projecting member 42 linearly translates the dead bolt 70 between a locked position wherein the first end 72 of the dead bolt 70 engages one of the detents 35 and an unlocked position, shown in FIG. 4, wherein the first end 72 of the dead bolt 70 does not engage any of the detents 35. Accordingly, the linear actuation of the dead bolt 70 into and out of the detents 35 enables the first portion 20 of the housing to be rotationally locked relative to the second portion 30. In addition, the quantity and location of the detents 35 on the flange 32 define the predetermined locking orientations.

In accordance with certain aspects of the present invention, the predetermined locking orientations may coincide with some or all of the predetermined engagement orientations. For instance, in the illustrated embodiment, the switch lock 10 has three predetermined engagement orientations—"on" "off" and "auxiliary"—and two predetermined locking orientations which coincide with the "off" and "auxiliary" predetermined engagement orientations, respectively. As such, the motorcycle may be locked while in the "off" and "auxiliary" modes, but not in the "on" mode (i.e. the motorcycle may not be locked while the ignition is running).

The switch lock 10 of the present invention further comprises an electrical interface mechanism which is selectively actuated by the rotation of the first portion 20 of the housing. As best depicted in FIG. 2, the electrical interface mechanism generally comprises a plurality of metal leads 39 arranged on the outward-projecting side 38 of the flange 32, a disk 80 attached to the stem 24 of the first portion 20 of the housing, and a plurality of spaced-apart metal contacts 83 disposed on the disk 80. Preferably, the metal leads 39 project outwardly from the second portion 30 of the housing in a plug-like manner, as shown in FIGS. 1 and 2. Such an arrangement permits the switch lock 10 to be readily and conveniently connected to an external electrical system (not shown).

Figure 3:
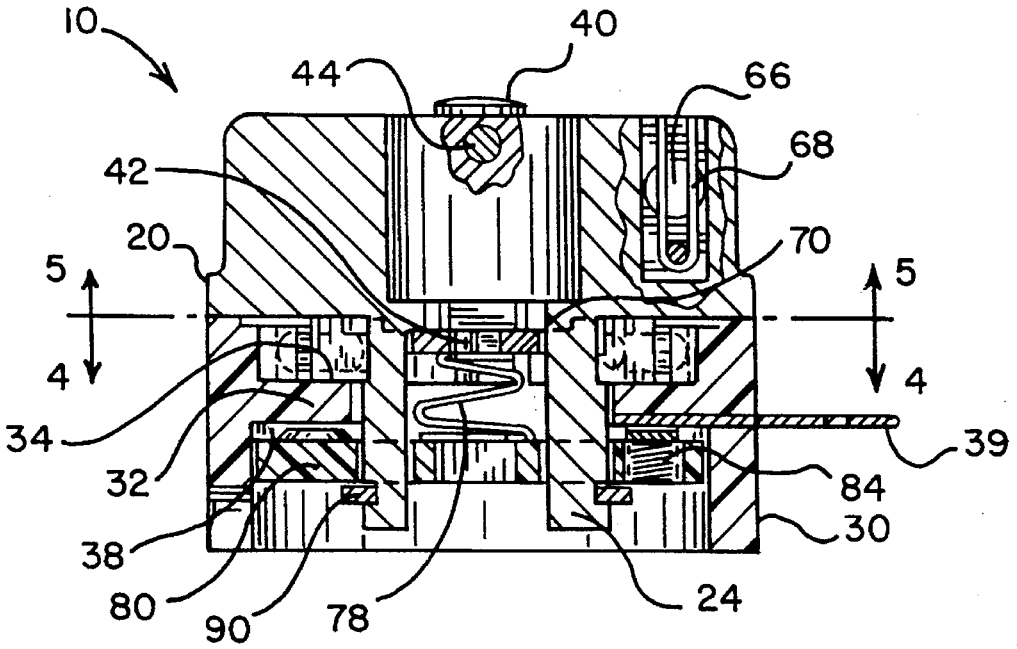
FIG. 3 is a cross-sectional view of the switch lock assembly taken along line 3—3 in FIG. 1.

The disk 80 is coupled to the stem 24 of the first portion 20 of the housing and is rotatably disposed within the second portion 30 of the housing. Thus, as the first portion 20 of the housing is rotated relative to the secondary second portion 30, the disk 80 rotates in concert with the first portion 20. As shown in FIG. 2, the disk 80 has an inner surface 82 and an outer surface 86. Preferably, the inner surface 82 of the disk 80 is in spaced relation with and is substantially parallel to the outward-projecting side 38 of the flange 32, as depicted in FIG. 3.

In the illustrated embodiment of the present invention, there are a total of three metal leads 39 and three metal contacts 83. Further, the metal leads 39 are arranged to coincide with the three predetermined engagement orientations—namely "on" "off" and "auxiliary". Moreover, two of the metal contacts 83 are arranged on the disk 80 to communicate with one or more of the three metal leads 39 when the first portion 20 of the housing is oriented properly with the second portion 30. In use, an electrical circuit is supplied when the first portion 20 of the housing is in either the "on" predetermined engagement orientation (i.e. two of the three metal contacts each communicate with two of the three metal leads and the remaining metal contact is grounded) or the "auxiliary" predetermined engagement orientation (i.e. two of the three metal contacts each communicate with one of the three metal leads and the remaining metal contact is grounded), but not when the first portion 20 of the housing is in the "off" predetermined engagement orientation (i.e. one of the three metal contacts communicates with two of the three metal leads and the two remaining metal contacts are grounded).

As an added feature of the present invention, the metal contacts 83 are raised slightly above the inner surface 82 of the disk 80. Further, in order to improve the communication between the metal contacts 83 and the metal leads 39, a small spring 84 is compressibly disposed between the inner surface 82 of the disk 80 and each metal contact 83, as shown in FIG. 2.

A retaining means is also provided for holding the disk 80 in position within the second portion 30 of the housing and for operatively connecting the second portion 30 of the housing to the first portion 20. In the illustrated embodiment, the retaining means comprises a single annular ring 90 which is received by a groove 26 formed in the stem 24 of the first portion 20 of the housing. Also, a spring 78, compressibly disposed between the inner surface 82 of the disk 80 and the dead bolt 70, is provided to ensure that the inner surface 82 of the disk 80 is in spaced relation with and is substantially parallel to the outward-projecting side 38 of the flange 32.

We claim as our invention:

1. A switch lock assembly comprising:

a housing having a first portion and a second portion, the first portion partially rotatable relative to the second portion and including a handle portion for facilitating rotation thereof, the handle portion having a bore therethrough, the second portion adapted to be fixedly mounted to an external object;

a lock plug assembly rotatably disposed in the bore of the handle portion; and an externally mounted side-opening door hingedly attached to the first portion of the housing and forming part of the handle portion, the side-opening door outwardly rotatable between an open position wherein the lock plug assembly is exposed and a closed position wherein the lock plug assembly is covered.

2. A switch lock assembly as recited in claim 1, further comprising a latching means for securely retaining the side-opening door in the closed position.

3. A switch lock assembly as recited in claim 2, wherein the latching means comprises:

a stud attached to the side-opening door;

a face disposed on the handle portion of the housing, the face having an aperture which receives the stud when the side-opening door is rotated toward the closed position; and a clutching means for grasping the stud when the side-opening door is in the closed position.

4. A switch lock assembly as recited in claim 3, wherein the stud has a generally back-to-back cone-shaped head portion and an inboard stem portion, the thickest part of the head portion being thicker than the inboard stem portion and narrower than the aperture.

5. A switch lock assembly as recited in claim 4, wherein the clutching means comprises a generally U-shaped spring member disposed within the handle portion and inboard of the aperture, the U-shaped spring member widening to receive the head portion of the stud and then narrowing to grasp the head portion of the stud when the side-opening door is rotated toward the closed position and the stud is received by the aperture in the face of the handle portion.

6. A switch lock assembly as recited in claim 1, further comprising an urging-and-locking means for selectively urging the first portion of the housing into predetermined engagement orientations as the first portion is rotated relative to the second portion and for enabling the first portion to be locked relative to the second portion at predetermined locking orientations.

7. A switch lock assembly as recited in claim 6, wherein all of the predetermined locking orientations coincide with less than all of the predetermined engagement orientations.

8. A switch lock assembly as recited in claim 6, wherein the urging-and-locking means has three predetermined engagement orientations.

9. A switch lock assembly as recited in claim 6, wherein the urging-and-locking means has two predetermined locking orientations.

10. A switch lock assembly as recited in claim 6, wherein the urging-and-locking means has three predetermined engagement orientations and two predetermined locking orientations, the two predetermined locking orientations coinciding with two of the three predetermined engagement orientations.

11. A switch lock assembly as recited in claim 6, wherein the first portion of the housing has a stem which extends substantially through the second portion of the housing.

12. A switch lock assembly as recited in claim 11, wherein the urging-and-locking means comprises:

a flange formed within the second portion of the housing, the flange having an inward-projecting side and an outward-projecting side, the inward-projecting side having a plurality of detents and notches;

at least one spring-biased projecting pin attached to the first portion of the housing which retractably engages the notches;

a dead bolt having a first end and a second end, the dead bolt being slidably disposed on the inward-projecting side of the flange and within a channel formed in the stem of the first portion of the housing, the dead bolt being movable between a locked position wherein the first end of the dead bolt engages one of the detents of the internal side of the flange and an unlocked position wherein the first end of the dead bolt does not engage any of the detents; and a camming means for linearly translating the dead bolt between the locked and unlocked positions when the lock plug assembly is rotated.

13. A switch lock assembly as recited in claim 12, wherein two spaced-apart spring-biased projecting pins and between six and seven notches urge the first portion of the housing into three alternative predetermined engagement orientations as the first portion is rotated relative to the second portion.

14. A switch lock assembly as recited in claim 13, wherein two detents enable the first portion of the housing to be locked relative to the second portion of the housing at two alternative predetermined locking orientations.

15. A switch lock assembly as recited in claim 14, wherein the two predetermined locking orientations coincide with two of the three predetermined engagement orientations.

16. A switch lock assembly as recited in claim 12, wherein the camming means comprises an offset projecting member disposed on the lock plug assembly and a slot in the dead bolt which receives the offset projecting member, the offset projecting member linearly translating the dead bolt when the lock plug assembly is rotated.

17. A switch lock assembly as recited in claim 12, further comprising an electrical interface mechanism.

18. A switch lock assembly as recited in claim 17, wherein the electrical interface mechanism is selectively actuated by the rotation of the first portion of the housing.

19. A switch lock assembly as recited in claim 18, wherein the electrical interface mechanism comprises:

a plurality of metal leads arranged on the outward-projecting side of the flange;

a disk having an inner surface and an outer surface, the disk being coupled to the stem of the first portion of the housing and rotatably disposed within the second portion of the housing, the disk being arranged such that the inner surface of the disk is in spaced relation with and is substantially parallel to the outward-projecting side of the flange; and a plurality of spaced-apart metal contacts disposed above the inner surface of the disk and arranged to complete a circuit when the first portion of the housing is properly oriented with respect to the second portion of the housing.

20. A switch lock assembly as recited in claim 19, wherein the metal leads project outwardly from the second portion of the housing.

21. A switch lock assembly as recited in claim 19, wherein the spaced-apart metal contacts are spring loaded.

22. A switch lock assembly as recited in claim 19, wherein the electrical interface mechanism has three metal leads and three metal contacts.

23. A switch lock assembly as recited in claim 22, wherein the three metal leads are arranged to coincide with three predetermined engagement orientations.

24. A switch lock assembly as recited in claim 23, wherein a circuit is supplied when two of the three metal contacts each communicate with two of the three metal leads.

25. A switch lock assembly as recited in claim 23, wherein a circuit is supplied when two of the three metal contacts each communicate with one of the three metal leads.

26. A switch lock assembly as recited in claim 19, further comprising a retaining means for holding the disk in position within the second portion of the housing and for operatively connecting the second portion of the housing to the first portion of the housing.

27. A switch lock assembly as recited in claim 26, wherein the retaining means comprises an annular ring received by a groove formed in the stem of the first portion of the housing, the groove being arranged on the stem such that the annular ring engages the outer surface of the disk.

28. A switch lock assembly as recited in claim 19, further comprising a spring compressibly disposed between the inner surface of the disk and the dead bolt.

* * * * *

UNITED STATES PATENT AND TRADEMARK OFFICE

CERTIFICATE OF CORRECTION

PATENT NO. : 5,563,387

DATED : October 8 1996

INVENTOR(S) : Gary L. Myers and Robert Courtwright

It is certified that error appears in the above-identified patent and that said Letters Patent is hereby corrected as shown below:

col. 1, line 3, delete "Pat. No. 5,365,328" and insert --Pat. No. Des. 365,328--.

col. 3, line 44, delete "ring-biased" and insert --spring-biased--.

Signed and Sealed this

Seventeenth Day of December, 1996

*Attest:*

Bruce Lehman

BRUCE LEHMAN

*Attesting Officer*

*Commissioner of Patents and Trademarks*